US005702646A

United States Patent [19]

Braendli

[11] Patent Number: 5,702,646

[45] Date of Patent: Dec. 30, 1997

[54] MIXING HEAD FOR MIXING FLUIDS, IN PARTICULAR GASES AND/OR LIQUIDS

[76] Inventor: Mark Braendli, Asplistrasse 26, CH-5016 Erlinsbach, Switzerland

[21] Appl. No.: 596,107

[22] PCT Filed: May 18, 1995

[86] PCT No.: PCT/CH95/00111

§ 371 Date: Apr. 18, 1996

§ 102(e) Date: Apr. 18, 1996

[87] PCT Pub. No.: WO95/32794

PCT Pub. Date: Dec. 7, 1995

[30] Foreign Application Priority Data

May 31, 1994 [CH] Switzerland ..... 1700/94

[51] Int. Cl.[6] ..... B01F 3/04

[52] U.S. Cl. ..... 261/89; 366/330.2; 366/306; 366/171.1; 366/172.1

[58] Field of Search ..... 261/89; 366/295, 366/347, 330.1, 330.2, 306, 171.1, 172.1

[56] References Cited

U.S. PATENT DOCUMENTS

| | | | |
|---|---|---|---|
| 43,686 | 8/1864 | Hall | 366/306 |
| 1,351,352 | 8/1920 | Stevens | 366/306 |
| 1,720,549 | 7/1929 | Gilcrist | 366/330.1 |
| 1,725,279 | 8/1929 | Kantmann | 366/330.1 |
| 2,092,992 | 9/1937 | Thalman | 366/330.1 |
| 3,179,380 | 4/1965 | Drayer | 366/330.1 |
| 3,293,117 | 12/1966 | Pennington, Jr. et al. | 366/330.1 |
| 3,358,413 | 12/1967 | Kalika | 261/89 |
| 3,924,837 | 12/1975 | Knis et al. | 366/330.1 |
| 4,126,398 | 11/1978 | Phillips et al. | 366/330.2 |
| 4,834,545 | 5/1989 | Inoue et al. | 366/171.1 |

*Primary Examiner*—Tim R. Miles
*Attorney, Agent, or Firm*—Wenderoth, Lind & Ponack

[57] ABSTRACT

A mixing head to be mounted on a utilization system is operable to mix media and to then supply the mixed media to the utilization system. The mixing head includes a housing having an inlet end and an outlet end. The outlet end has an annular flange to enable the housing to be mounted on the utilization system. A rotor is mounted within the housing for rotation about an axis. The rotor includes an upstream axial flow impeller and a downstream radial flow impeller. Each impeller includes plural rigid and fixed blades. At the outlet end of the housing is an outlet in the form of an annular gap to supply mixed media from the housing into the utilization system. A deflection hood is mounted at the outlet end of the housing. The annular gap is positioned radially outwardly of the hood. The hood has an outer surface that is directed away from the housing and that has a convex shape.

13 Claims, 2 Drawing Sheets

MIXING HEAD FOR MIXING FLUIDS, IN PARTICULAR GASES AND/OR LIQUIDS

BACKGROUND OF THE INVENTION

The invention relates to a mixing head for mixing fluids, in particular various gases and/or liquids in a hot or cold environment.

EP-0 344 498 A2 discloses an impeller where, as alternative to conventionally used bucket wheels or blower wheels revolving in a housing, chain-like link elements are used for generating a rotation gas stream. Such blower in particular is used in the pneumatic transportion of dust, chips and cuttings such as accumulate in wood and plastic processing. Such blower also can be used in the field of heating, for example for flue gas conveyance, and the chain-like link elements serve in particular for the purpose of reducing cleaning of the blower, especially if the gas to be conveyed is strongly loaded with dust. In such known blower it is furthermore suggested that a deflecting surface oppose the drive side to prevent gases inflowing centrally from escaping axially. This ensures that the gas stream through the blower must be moved into the rotation path of the rotating link chain so that a mixing of the gas stream results, in particular by being swirled by the chain-like link elements.

Such movable chain-like link elements however can tear, particularly during the starting phase of rotation, or they can become jammed one against the other. Also, with vertical mounting of the link head, during a starting phase until the chain rings have become opened, considerable loading of motor bearings occurs since the chain rings, until they are completely opened, are largely imbalanced. Furthermore no possibilities for adding further fluid components are provided.

EP-0 473 618 B1 describes a similar blower which comprises a blower wheel or impeller with a central hub and elements fastened thereon and movable with respect to one another. Such elements are in the form of chain pieces in order to achieve a spiral or worm-shaped gas stream in a device for combusting bio or solid substances.

EP-0 525 711 A2 also discloses a device for the combustion of bio or solid substances by a channel and a similar link head fan whose outlet is directed into the interior of a gas or fire tube.

A mixing device which supplies an axial air stream against the direction of flow of a spiral-shaped rotating gas stream of wide area is known from EP-A0 340 859 A2. As is the case with known mixing devices, however, such device is insufficient or lacking with respect to ability to change mixing components.

SUMMARY OF THE INVENTION

It is the object of the invention to provide a dynamically operating mixing head which can be adjusted to change mixing tasks in order to achieve intensive thorough mixing and homogeneous mixtures without having to accept the disadvantages in moving parts.

This object is achieved by provision of a mixing head including an impeller achieving axial flow positioned before an impeller achieving radial flow, in the stream direction.

Such arrangement provides an axial drawing-in of the fluid to be transported as well as also a radial acceleration thereof, thus providing intensive swirling. Through this combination of impellers achieving axial flow with radial flow, the blades of which are preferably fastened on a common hub, an effective through-mixing results which can be achieved for various gases and/or liquids, e.g. the mixing of additives and air can be achieved sufficiently in the area of a housing of the head. Thus, a second gas component can be supplied through an admixing port disposed on a front face with the drawing in taking place by means of the axial flow impeller. This means that the mixing device can also be used in installations which are not operated at underpressure. On the other hand, outside of the region of rotation of the radial flow impeller, i.e. essentially at the peripheral boundary of the mixing head housing, several nozzles can be provided, for example for adding liquid additives so that several components can be mixed into the carrier fluid which, in general, is air.

A stationary deflection hood is disposed in the direction of flow after or downstream of the rotation region of the radial flow impeller and has guide elements, particularly guide channels, extending outwardly in the direction of rotation. In contrast to the known deflecting surface according to EP-0 344 498, in which gas present is deflected through the guide elements extending outwardly in the direction of rotation, gases flowing back are already guided in the rotational direction of rotation which prevents unchecked turbulence in the marginal region of the flowback premixer. This flowback premixer is formed as a deflection hood in the shape of a hemisphere and is especially advantageous.

Further embodiments are characterized in the dependent claims.

BRIEF DESCRIPTION OF THE DRAWINGS

An embodiment of the invention is described and explained in the following in conjunction with the accompanying drawings, in which.

DETAILED DESCRIPTION OF THE INVENTION

Figure 1:
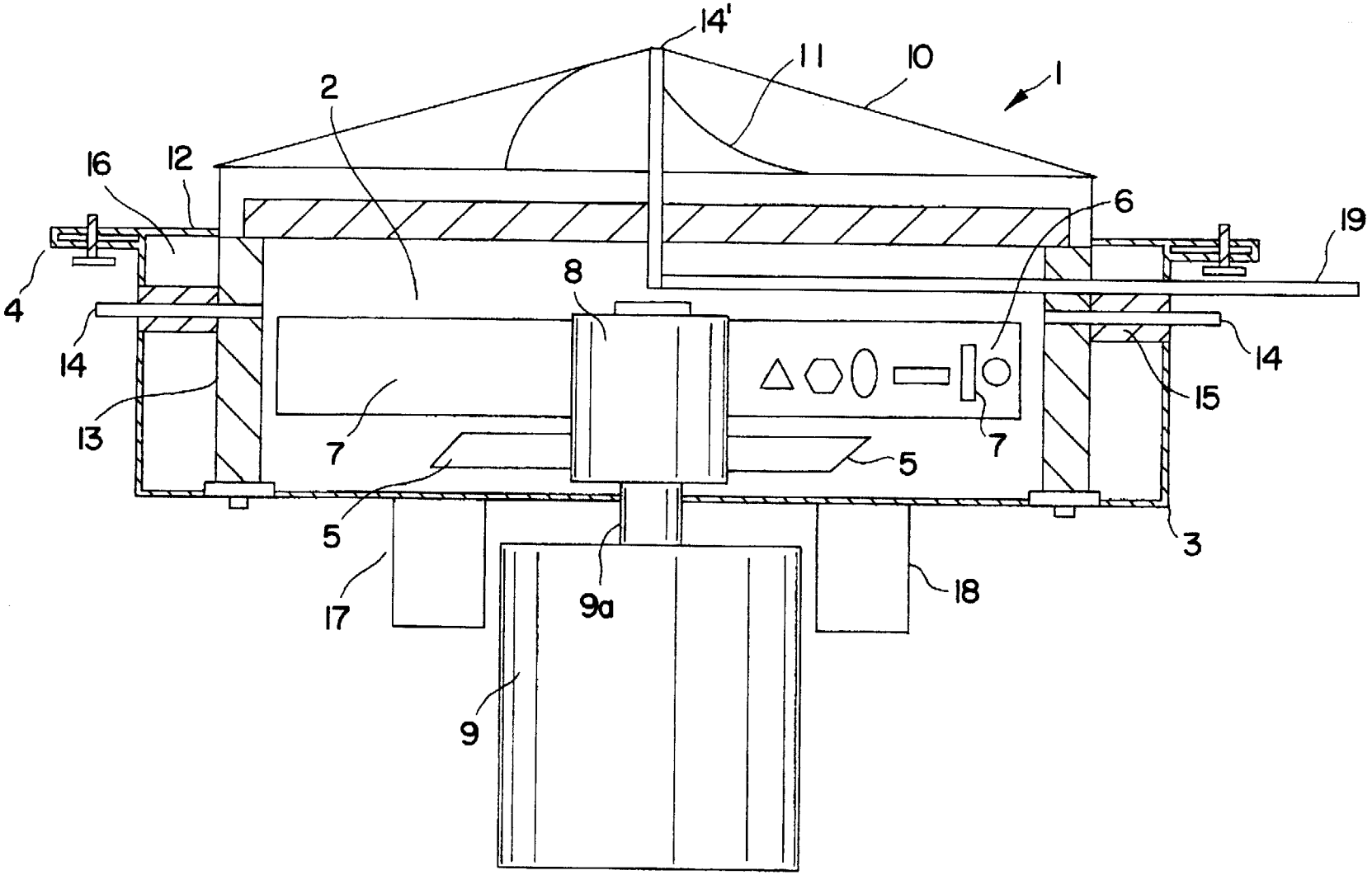
FIG. 1 is a schematic cross section through a mixing head.
Figure 2:
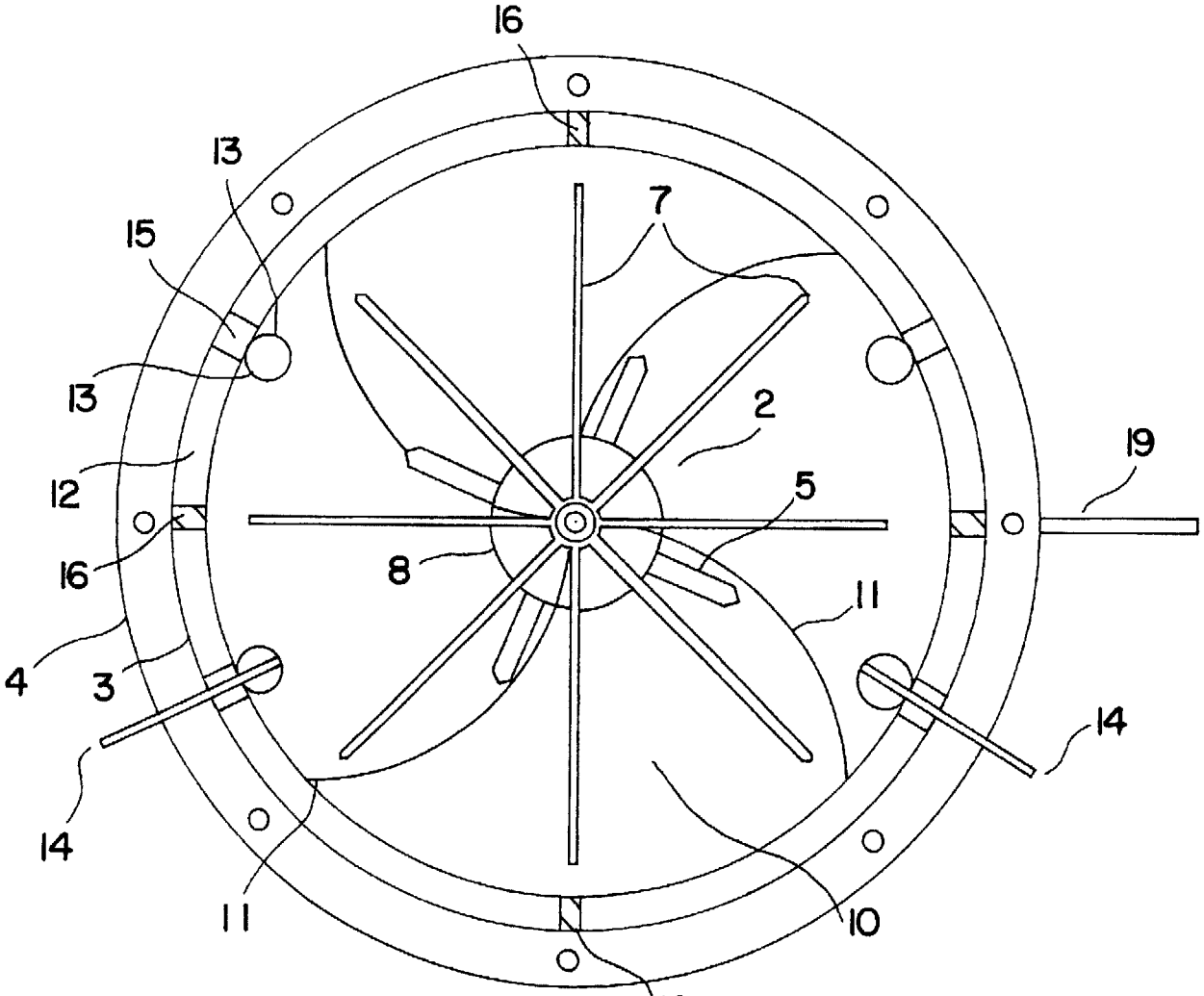
FIG. 2 is a top view of a rotor disposed in the mixing head.

As shown in FIG. 1, a mixing head 1 according to the invention comprises essentially a rotor 2 and a housing 3 which is affixed by an annular flange 4 on, for example, an air transport path of utilization system, e.g. a cylinder reactor or a cylinder muffle furnace. Housing 3 has inlets 17, 18 into which medium is passed.

The rotor 2 comprises two impellers or blower wheels disposed one behind the other in the axial direction. One impeller generates an axial throughflow by means of obliquely inclined blades 5. The other impeller 6 generates a radial flow by means of blades 7 oriented axially. The blades 7 and the blades 5 are mounted on a common hub 8 of a shaft 9*a* driven by a motor 9.

In a preferred embodiment, the blades 5 and 7 are constructed to be exchangeable, for example they are detachably fastened by plug connections on the hub 8. The blades 7 can have different cross sections, for example triangular, planar or oval. The selection of material of blades 5 and 7 depends on the media to be mixed. The blades 5 are obliquely inclined and the degree of inclination depends on the quantity to be transported of the medium to be drawn in. For such purpose, the length and width of the blades 5 also can be varied. Thus, it is possible, e.g. if a relatively large transport stream is to be generated, to employ blades 5 with a greater width and/or length. For better mixing, the blades 7 can deviate from a smooth surface and can therefore be perforated or ribbed.

The housing 3 at the axial side or end thereof opposite an inlet end has a conical or semiconical deflection hood 10 located centrally of housing 3 and rotor 2. Hood 10 forms a back-flow deflector of flow. The outer surface of hood 10, opposite the side facing rotor 2, has guide elements 11 curved radially outwardly and backward in the direction of rotation. These guide elements 11 deflect the mixed medium flowing back toward mixing head i in the axial direction. The deflection hood 10 preferably has the shape of a conical or semiconical calotte the diameter of which is a function of the application environment and of the media to be mixed.

The deflection hood 10 can have a greater diameter than the impeller 6. An annular outlet 12 for the fluid mixture or gas mixture preferably is in the form of a lateral gap if the deflection hood 10 has a greater radius than the impeller 6. If the deflection hood 10 has a smaller radius than the impeller 6, the outlet 12 preferably is an annular gap. To improve flow, for example of very viscous media, guide blades 16 can be disposed in gap 12.

The deflection hood 10 preferably is secured by columns 13 that may have conduits 15 for cooling. Depending on the particular conditions, water or thermal oil can be used as coolant.

Outwardly of the rotation area of impeller 6 are provided nozzles 14 for introducing liquid additives. Liquid mist at the outer ends of the radial blades 7 immediately is rent apart and mixed with the gas stream. In preferred manner, the nozzles 14 are oriented tangentially to a plane of rotation of blades 7 in order to utilize optimally the suction of the rotating medium. On the other hand, orienting the nozzles in a more radial orientation enables choking or regulation of the supplied additive to be effected. The nozzles 14 are preferably protected through pipe-shaped ports which can be attached to the conduits 15 for cooling the nozzles 14.

To introduce liquids which are under high pressure, for example liquid fuel, a nozzle 14' is directed into the apex of the deflection hood 10 and is connected to a feed line 19 extending through housing 3.

I claim:

1. A mixing head to be mounted on a utilization system and operable to mix media and to then supply the thus mixed media to the utilization system, said mixing head comprising:

a housing having a media inlet end and a media outlet end, said media outlet end having an annular flange to enable said housing to be mounted on the utilization system;

a rotor mounted within said housing for rotation about an axis extending in an axial direction from said inlet end toward said outlet end, said rotor comprising an upstream axial flow impeller and a downstream radial flow impeller, relative to a direction of media flow from said inlet end to said outlet end, each said impeller including plural rigid and fixed blades, whereby said rotor achieves intense swirling mixing of the media within said housing;

said housing having at said outlet end thereof an outlet in the form of an annular gap for supply of the mixed media into the utilization system; and a deflection hood mounted at said outlet end of said housing with said annular gap being outwardly of said hood, said hood having an outer surface directed away from said housing, said outer surface having a convex hemispherical or conical shape.

2. A mixing head as claimed in claim 1, wherein said outer surface of said hood has guide elements.

3. A mixing head as claimed in claim 2, wherein said guide elements are curved radially outwardly and backwardly in a direction of rotation.

4. A mixing head as claimed in claim 1, wherein said hood is mounted to said housing by columns.

5. A mixing head as claimed in claim 4, further comprising cooling conduits for cooling said columns.

6. A mixing head as claimed in claim 1, further comprising nozzles for introducing additive to a position outwardly of said blades of said radial flow impeller.

7. A mixing head as claimed in claim 6, wherein said nozzles are covered by conduits.

8. A mixing head as claimed in claim 6, wherein said nozzles are oriented tangentially of a plane of rotation of said blades of said radial flow impeller.

9. A mixing head as claimed in claim 1, further comprising at least one inlet port at said inlet end of said housing.

10. A mixing head as claimed in claim 1, wherein said blades of said axial flow impeller and said blades of said radial flow impeller are attached to a common hub.

11. A mixing head as claimed in claim 10, wherein said blades are exchangeably attached to said hub.

12. A mixing head as claimed in claim 1, further comprising guide plates positioned in said annular gap.

13. A mixing head as claimed in claim 1, wherein said outer surface of said hood has formed therein guide channels.

* * * * *